United States Patent [19]

Burton, III

[11] 4,109,718

[45] Aug. 29, 1978

[54] METHOD OF BREAKING SHALE OIL-WATER EMULSION

[75] Inventor: Robert S. Burton, III, Grand Junction, Colo.

[73] Assignee: Occidental Oil Shale, Inc., Grand Junction, Colo.

[21] Appl. No.: 737,556

[22] Filed: Nov. 1, 1976

Related U.S. Application Data

[63] Continuation-in-part of Ser. No. 644,513, Dec. 29, 1975, abandoned, which is a continuation of Ser. No. 481,975, Jun. 24, 1974, abandoned.

[51] Int. Cl.[2] ..... E21B 43/24

[52] U.S. Cl. ..... 166/256; 166/259; 166/266; 166/267; 166/302; 299/2

[58] Field of Search ..... 166/256, 259, 265, 266, 166/267, 272, 302; 299/2; 208/11 R, 187, 188

[56] References Cited

U.S. PATENT DOCUMENTS

| | | | |
|---|---|---|---|
| 1,433,956 | 10/1922 | Knox | 166/267 |
| 2,434,815 | 1/1948 | Shaw | 208/11 R |
| 2,481,051 | 9/1949 | Uren | 299/2 |
| 2,497,868 | 2/1950 | Dalin | 166/256 |
| 3,051,644 | 8/1962 | Friedman et al. | 208/11 R |
| 3,066,732 | 12/1962 | McEver | 166/266 |
| 3,112,255 | 11/1963 | Campion | 208/11 R |
| 3,135,325 | 6/1964 | Parker | 166/266 |
| 3,267,998 | 8/1966 | Simpson | 166/266 |
| 3,379,248 | 4/1968 | Strange | 166/256 |
| 3,380,913 | 4/1968 | Henderson | 166/267 X |
| 3,593,790 | 7/1971 | Herce | 166/267 |
| 3,888,760 | 6/1975 | Ebert | 208/187 |
| 3,892,276 | 7/1975 | Wells | 166/267 |
| 3,929,625 | 12/1975 | Lukas | 208/188 |
| 3,945,435 | 3/1976 | Barry | 166/267 |

OTHER PUBLICATIONS

Petroleum Production Handbook, pp. 6-27-6-35.

Uren, L. C., Petroleum Production Engineering-Oil Field Exploitation, Third Edition, 1953, pp. 573-575.

*Primary Examiner*—Stephen J. Novosad

*Assistant Examiner*—George A. Suchfield

*Attorney, Agent, or Firm*—Christie, Parker & Hale

[57] ABSTRACT

A technique is described for breaking the very strong emulsion of shale oil and water produced by an in situ oil shale retorting process so that separate shale oil and water phases can be recovered. The emulsion is broken by heating it to a temperature of at least about 120° F and holding at a temperature in the range of from about 120° to 180° F for about one day. Preferably the shale oil and water are held in the range of from about 130° to 150° F for about one day and the phases separated by gravity. Heat for the process can be obtained by injecting water into a spent in situ oil shale retort for generating steam and transferring heat from the steam to the emulsion.

16 Claims, 1 Drawing Figure

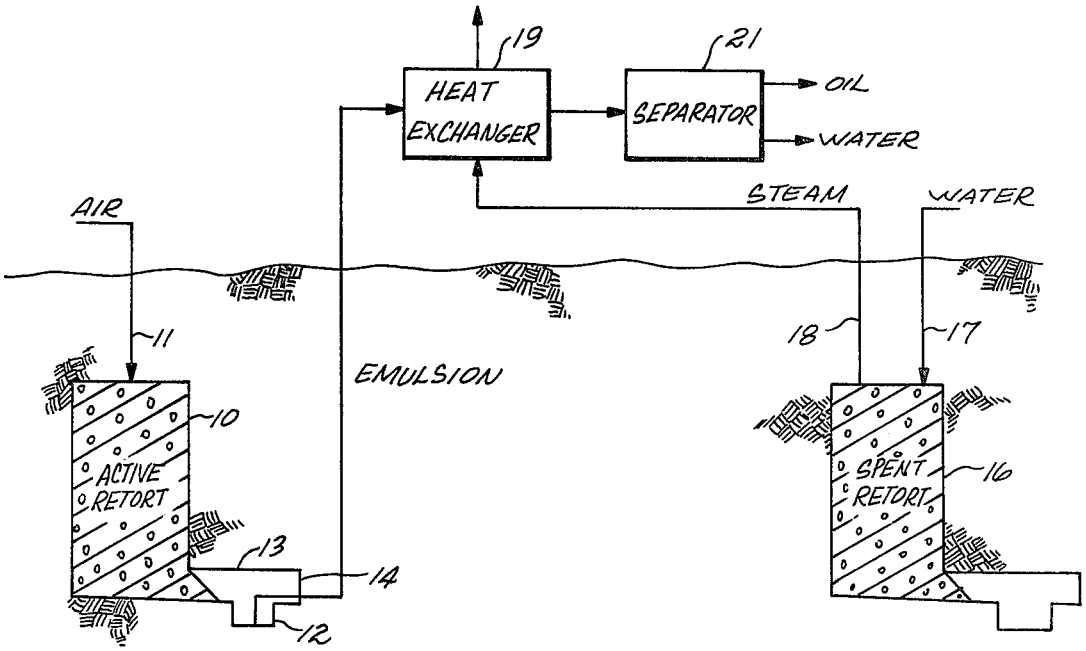
19
21
HEAT EXCHANGER
SEPARATOR
OIL
WATER
STEAM
WATER
AIR
11
18
17
EMULSION
10
ACTIVE RETORT
SPENT RETORT
16
13
14
12

METHOD OF BREAKING SHALE OIL-WATER EMULSION

BACKGROUND

This application is a continuation-in-part of U.S. Pat. application Ser. No. 644,513, filed Dec. 29, 1975, which is a continuation of U.S. Patent application Ser. No. 481,975, filed June 24, 1974 both of which are now abandoned.

There are vast deposits of oil shale in the world containing massive reserves of oil that can supplement or replace petroleum supplies. The oil shale contains kerogen which is a solid carbonaceous material from which shale oil can be retorted. Oil shale is retorted by heating the oil shale to a sufficient temperature to decompose kerogen and produce a liquid product known as shale oil which is recovered. Small amounts of hydrocarbon gas are also produced. The spent shale, after kerogen has been decomposed, contains substantial amounts of residual carbon which can be burned to supply heat for retorting.

In a particularly desirable process for retorting oil shale a subterranean cavity or room known as an in situ oil shale retort contains a fragmented permeable mass of oil shale particles and retorting is conducted in situ. The fragmented permeable mass of particles in the underground retort is formed explosively by any of a variety of known techniques. This retort can be filled to or near the top with a fragmented permeable mass of oil shale particles sometimes known as a rubble pile. The top of this fragmented mass of oil shale particles is ignited and air or other oxygen bearing gas is forced downwardly therethrough for combustion of carbonaceous material in the shale. Initially some of the shale oil may be burned but as retorting progresses some of the combustion is of residual carbon remaining in the spent shale. This reduces the oxygen content of the air and the resultant gas passing downwardly through the retort on the advancing side of the combustion zone is essentially inert. This inert gas transfers heat downwardly and results in retorting of the shale in a retorting zone on the advancing side of the combustion zone without appreciable combustion of the resulting oil.

The products recovered from the bottom of the retort include a low heating value off gas, liquid shale oil and water. Some separate shale oil and water phases can be recovered at the bottom of the retort but much of the product is in the form of a viscous emulsion of water and shale oil. This emulsion forms in the retort under conditions that are not fully understood and may very well involve condensation of water vapor on surfaces having dispersed oil. It is known that the emulsion from the bottom of the in situ oil shale retort is particularly difficult to break by known techniques. A variety of chemical treatments of emulsion have been attempted to cause a separation of the oil and water into separable phases and no appropriate economical technique has been discovered.

Petroleum-water emulsions are sometimes encountered in producing oil from wells. Emulsion breaking chemicals can be used for separating such an emulsion. A heater-treater can be used either alone or in combination with chemicals. A heater-treater is essentially a large vessel wherein an emulsion is heated by immersed heater tubes and travels over trays or through a filtering medium to separate oil and water. Average residence time of oil in a heater-treater is in the order of two to ten hours, although four to five hours seems to be most typical.

A heater-treater is shown in the *Petroleum Production Handbook,* edited by Thomas C. Frick and published by Society of Petroleum Engineers of A.I.M.E., Dallas, Tex. (1962), along with related information at pages 6–27 to 6–35. Although this discussion concerns preparation of power oil for use in downhole hydraulic pumps for pumping oil wells, the description of the heater-treater is not unique to this application of the equipment.

Efforts have been made to separate the shale oil-water emulsion from in situ oil shale retorting using a conventional petroleum heater-treater. Heating has been in the range of from about 150° to 170° F with various chemical additives and electrostatic fields employed for enhancing separation. Although some success has been obtained, the technique is not completely satisfactory and the equipment costs are high for a selected production rate.

The large amount of water present in the oil significantly affects its properties, including its viscosity. The emulsion is sluggish and difficult to handle and can involve a substantial storage and shipment problem since there may be up to 75% water in the emulsion. It is also desirable to separate water from the oil for use at the site of retorting. It is therefore desirable to provide a technique for economically breaking the shale oil-water emulsion from an in situ oil shale retort.

BRIEF SUMMARY OF THE INVENTION

There is, therefore, provided in practice of this invention a simple process for breaking the emulsion of shale oil and water from an in situ oil shale retort by holding the shale oil and water at a temperature of at least about 120° F for at least about one day and separating shale oil and water. Good separations are obtained by holding the shale oil and water at a temperature in the range of from about 130° F to 150° F for about one day or until the shale oil and water are substantially separated.

DRAWING

These and other features and advantages of the present invention will be appreciated as the same becomes better understood by reference to the following detailed description of a presently preferred embodiment when considered in connection with the accompanying drawing which illustrates in schematic form a process for separately recovering shale oil and water from an underground in situ oil shale retort.

DESCRIPTION

The drawing is a semi-schematic vertical cross section drawn without regard to scale since relative dimensions are not of significance in practice of this invention. As illustrated in this presently preferred embodiment there is an active in situ oil shale retort 10 containing a fragmented permeable mass of particles bounded by unfragmented formation containing oil shale.

The fragmented permeable mass of oil shale particles is formed by excavating at least one void within the boundaries of the retort being formed and explosively expanding a portion of the formation toward such a void. Several techniques have been described for forming an in situ oil shale retort.

After the fragmented permeable mass is formed a combustion zone is established by igniting carbonaceous material in the oil shale. Air or other oxygen bearing gas is introduced through a conduit 11 to the fragmented permeable mass in the retort 10. The oxygen bearing gas introduced into the combustion zone causes the combustion zone to advance through the fragmented permeable mass. Heated gas from the combustion zone passing through the retort establishes a retorting zone on the advancing side of the combustion zone. Oil shale particles are heated within the retorting zone and kerogen in the oil shale is decomposed to form gaseous and liquid products including shale oil. Shale oil percolates through the fragmented permeable mass and flows from the in situ oil shale retort into a sump 12 in a laterally extending drift 13. Off gas from the in situ oil shale retort is also withdrawn through the access drift 13 through a gas tight bulkhead 14.

Water vapor is present in the retorting zone in an active in situ oil shale retort. There are several potential sources for such water including connate water in the subterranean formation, water leaking into the in situ oil shale retort from underground aquifers, water introduced with the oxygen bearing gas for retorting, and/or combustion products from the combustion zone.

Raw or unretorted oil shale on the advancing side of the retorting zone can be at a temperature below the dew point of the gas in the retorting zone. This leads to condensation of water. The unretorted oil shale can also include shale oil on its surfaces percolating downwardly from the retorting zone. Some components of the shale oil may be vaporized in the retorting zone and also be condensing on unretorted oil shale. The exact mechanisms occurring in the retort on the advancing side of the retorting zone are not known. It is known, however, that a shale oil-water emulsion is recovered from the sump 12 on the advancing side of the retorting zone. In some cases reasonably dry shale oil and/or reasonably clean water can be obtained. Substantial amounts of shale oil-water emulsion can also occur.

The emulsion of shale oil and water from an in situ oil shale retort turns out to be particularly difficult to break as compared with ordinary emulsions of petroleum and water. It is believed that this can be a result of the mode of formation of the emulsion by condensation on oil shale on the advancing side of the retorting zone in an in situ oil shale retort. It is also possible that the products of retorting are sufficiently different in chemistry or structure to form more stable emulsions than are usually encountered in petroleum production.

The tight, or difficult to break, emulsion of water and shale oil is withdrawn from the sump 12 to a heat exchanger 19. Steam from a spent in situ oil shale retort 16, as described in greater detail hereinafter, is also passed through heat exchanger 19 so that the shale oil and water are heated by heat extracted from the steam. The heat exchanger 19 can be of any conventional variety or can simply be an arrangement of pipes immersed in a temporary reservoir for the shale oil and water. A suitable reservoir is a tank or a subterranean chamber having a capacity of at least one day of production from the in situ oil shale retort.

Sufficient heat is supplied to the emulsion to raise its temperature to at least about 120° F and preferably into the range of from about 130° to 150° F. Temperatures as high as 180° F can be used although not considered necessary. It is found that when the shale oil-water emulsion is held in about this temperature range for at least about one day the shale oil and water are substantially separated. The mixture is separated into these two phases in a separator 21 which can simply be a reservoir with weirs and separate outlets so that the shale oil and water fractions can be separately removed by gravity separation. If desired the heat exchanger and separator can be combined by providing a reservoir sufficiently large to hold the shale oil and water at the selected temperature for at least about one day with heating pipes immersed in the liquid in the reservoir. An underground reservoir with weirs can be used and heating can be by way of hot retorting off gas from the in situ oil shale retort.

The shale oil-water emulsion from an in situ oil shale retort is found to be quite resistant to conventional techniques for breaking a petroleum-water emulsion. No conventional dewatering agents or de-emulsifying chemicals have been found which significantly enhance breaking of the emulsion at a reasonable cost. Residence times of a few hours in a conventional heater-treater at 150° to 180° F are no more effective in breaking the emulsion than the simple and economical technique provided in practice of this invention.

It has been found that by holding the emulsion at a temperature of at least about 120° F and preferably in the range of from about 130° to 150° F for at least about one day the emulsion breaks into easily separable fractions and only about 1% of water remains in the oil, which is considered a clean separation in light of the high proportion of water originally in the emulsion.

Prior to breaking the emulsion it can be a thixotropic fluid that flows so long as pumping is continued. When pumping is stopped the fluid tends to set up much like a gel and it is difficult to get moving again. After the emulsion has been heated to break the emulsion, the shale oil has a pour point in the order of about 70° F which can be handled without significant difficulty.

After the combustion zone has passed through the fragmented permeable mass of oil shale particles in an in situ oil shale retort, there is considerable sensible heat remaining in the spent shale which was heated during retorting and burning. Some portions of the spent shale in the retort can be at temperatures of several hundred degrees Fahrenheit although portions near the top can be substantially cooled by passage of inlet air or oxygen bearing gas as lower portions are retorted. The drawing illustrates a spent retort 16 which contains substantial residual heat. Shale oil has been recovered from the spent retort 16 by advancing a retorting zone therethrough. A combustion zone has also advanced through a substantial portion of the fragmented permeable mass of oil shale particles in the spent retort to provide heat for retorting. The structure of the spent retort 16 is generally similar to that of the active retort 10 hereinabove described, and remains closed at the bottom out of communication with the balance of the mining system employed in initially forming the retorts. The structure at the bottom of the spent retort 16 is of no further concern.

A conduit 17 is provided into the spent retort 16 and through cool parts of the fragmented permeable mass so that water can be injected into a heated portion of the fragmented permeable mass of spent oil shale particles therein. When water contacts heated spent shale particles substantial amounts of steam are generated. Although this steam can be at nominal pressures and temperatures, large amounts of heat can be involved. A second conduit 18 extracts steam from a heated portion of the spent shale retort. The two conduits 17 and 18 can be separated from each other so that water is injected into one portion of the spent retort and steam is extracted from a different portion. Alternatively the same bore hole can be used for both a water pipe and a steam pipe even though somewhat wet steam is obtained when water is injected near the steam exit. Steam from the conduit 18 from the spent retort can be used in the heat exchanger 19 for maintaining the emulsion at temperatures sufficient to separate the shale oil and water.

Although but one embodiment of technique for breaking the emulsion of shale oil and water from an in situ oil shale retort has been described and illustrated herein many modifications and variations will be apparent to one skilled in the art. Thus, for example, instead of using steam from a spent in situ oil shale retort, off gas from an active retort can be burned to provide heat for this purpose. Hot retorting off gas, waste heat from generators or other economical sources of relatively low temperature heat can be used. It is desirable, however, to use the heat from a spent in situ oil shale retort since it would otherwise be wasted, and off gas from an active retort can be usable as a fuel for generating electric power or the like. Many other modifications and variations will be apparent to one skilled in the art and it is therefore to be understood that within the scope of the appended claims the invention may be practiced otherwise than as specifically described.

What is claimed is:

1. A process for recovering shale oil from an in situ oil shale retort in a subterranean formation containing oil shale, said in situ oil shale retort containing a fragmented permeable mass of particles containing oil shale, comprising the steps of:

advancing a retorting zone through the fragmented permeable mass for retorting oil shale in the fragmented permeable mass and producing liquid and gaseous products including shale oil, water vapor being present in the retorting zone;

condensing at least a portion of such water vapor on unretorted particles in the fragmented mass on the advancing side of the retorting zone whereby an emulsion of shale oil and water is produced;

withdrawing liquid and gaseous products including such emulsion of shale oil and water from the fragmented mass; and holding the shale oil and water at a temperature of at least about 120° F for at least about one day for separating shale oil and water.

2. A process as recited in claim 1 wherein the shale oil and water are held in the range of from about 130° to 150° F for about one day.

3. A process for recovering shale oil from an in situ oil shale retort in a subterranean formation containing oil shale, said in situ oil shale retort containing a fragmented permeable mass of particles containing oil shale, comprising the steps of:

retorting oil shale in the fragmented permeable mass and producing an emulsion of shale oil and water;

injecting water into a spent shale retort for generating steam;

heating the emulsion of shale oil and water with the generated steam; and holding the shale oil and water at a temperature of at least about 120° F for at least about one day for separating shale oil and water.

4. A process for recovering shale oil from an in situ oil shale retort in a subterranean formation containing oil shale, said in situ oil shale retort containing a fragmented permeable mass of particles containing oil shale, comprising the steps of:

retorting oil shale in the fragmented permeable mass and producing an emulsion of shale oil and water; and providing sufficient heat to maintain the shale oil and water at a temperature of at least about 120° F for about one day for separating shale oil and water.

5. A process as recited in claim 4 wherein the shale oil and water are held in the range of from about 130° to 180° F for about one day.

6. A process for recovering shale oil from an in situ oil shale retort in a subterranean formation containing oil shale, said in situ oil shale retort containing a fragmented permeable mass of particles containing oil shale, comprising the steps of:

retorting oil shale in the fragmented permeable mass and producing an emulsion of shale oil and water;

injecting water into a spent shale retort for generating steam; and heating the emulsion of shale oil and water with the generated steam for providing sufficient heat to maintain the shale oil and water at a temperature of at least about 120° F for at least about one day for separating shale oil and water.

7. A process for recovering shale oil from an in situ oil shale retort in a suberranean formation containing oil shale, said in situ oil shale retort containing a fragmented permeable mass of particles containing oil shale, comprising the steps of:

advancing a retorting zone through the fragmented permeable mass for retorting oil shale in the fragmented permeable mass and producing liquid and gaseous products including shale oil, water vapor being present in the retorting zone;

condensing at least a portion of such water vapor on unretorted particles in the fragmented mass on the advancing side of the retorting zone whereby an emulsion of shale oil and water is produced;

withdrawing liquid and gaseous products including such emulsion of shale oil and water from the fragmented mass; and holding the shale oil and water at a temperature in the range of from about 120° to 180° F until shale oil and water are substantially separated.

8. A process as recited in claim 7 wherein the shale oil and water are held in the range of from about 130° to 180° F for about one day.

9. A process for recovering shale oil from an in situ shale retort in a subterranean formation containing oil shale, said in situ oil shale retort containing a fragmented permeable mass of particles containing oil shale, comprising the steps of:

injecting water into a spent shale retort for generating steam;

heating the emulsion of shale oil and water with the generated steam; and retorting oil shale in the fragmented permeable mass and producing an emulsion of shale oil and water;

holding the shale oil and water at a temperature in the range of from about 120° to 180° F until shale oil and water are substantially separated.

10. A process for recovering shale oil from an in situ oil shale retort in a subterranean formation containing oil shale, said in situ oil shale retort containing a fragmented permeable mass of particles containing oil shale, comprising the steps of:

advancing a retorting zone through the fragmented permeable mass for retorting oil shale in the fragmented permeable mass and producing liquid and gaseous products including shale oil, water vapor being present in the retorting zone;

condensing at least a portion of such water vapor on unretorted particles in the fragmented mass on the advancing side of the retorting zone whereby an emulsion of shale oil and water is produced;

withdrawing liquid and gaseous products including such emulsion of shale oil and water from the fragmented mass; and providing sufficient heat to maintain the shale oil and water at a temperature in the range of from about 120° to 180° F until shale oil and water are substantially separated.

11. A process as recited in claim 10 wherein the shale oil and water are held in the range of from about 130° to 180° F for about one day.

12. A process for recovering shale oil from an in situ oil shale retort in a subterranean formation containing oil shale, said in situ oil shale retort containing a fragmented permeable mass of particles containing oil shale, comprising the steps of:

retorting oil shale in the fragmented permeable mass and producing an emulsion of shale oil and water;

injecting water into a spent shale retort for generating steam; and heating the emulsion of shale oil and water with the generated steam for providing sufficient heat to maintain the shale oil and water at a temperature in the range of from about 120° to 180° F until shale oil and water are substantially separated.

13. A process for recovering shale oil from an in situ oil shale retort in a subterranean formation containing oil shale, said in situ oil shale retort containing a fragmented permeable mass of particles containing oil shale, comprising the steps of:

advancing a retorting zone through the fragmented permeable mass for retorting oil shale and producing shale oil, and wherein water vapor is present in the retorting zone and an emulsion of shale oil and water forms on the advancing side of the retorting zone;

withdrawing shale oil and water emulsion from the in situ oil shale retort on the advancing side of the retorting zone; and holding the shale oil and water at a temperature of at least about 120° F for one day for separating shale oil and water.

14. A process as recited in claim 13 wherein the shale oil and water are held in the range of from about 130° to 180° F for about one day.

15. A process for recovering shale oil from an in situ oil shale retort in a subterranean formation containing oil shale, said in situ oil shale retort containing a fragmented permeable mass of particles containing oil shale, comprising the steps of:

advancing a retorting zone through the fragmented permeable mass for retorting oil shale and producing shale oil, and wherein water vapor is present in the retorting zone and an emulsion of shale oil and water forms on the advancing side of the retorting zone;

withdrawing shale oil and water emulsion from the in situ oil shale retort on the advancing side of the retorting zone;

injecting water into a spent shale retort for generating steam;

heating the emulsion of shale oil and water with the generated steam and holding the shale oil and water at a temperature of at least about 120° F for at least about one day for separating shale oil and water.

16. A process for recovering shale oil from an in situ oil shale retort in a subterranean formation containing oil shale, said in situ oil shale retort containing a fragmented permeable mass of particles containing oil shale, comprising the steps of:

retorting oil shale in the fragmented permeable mass and producing an emulsion of shale oil and water; and holding the shale oil and water at a temperature in the range of from about 120° F to 180° F for about one day for separating shale oil and water.

* * * * *

UNITED STATES PATENT AND TRADEMARK OFFICE

CERTIFICATE OF CORRECTION

PATENT NO. : 4,109,718

DATED : August 29, 1978

INVENTOR(S) : Robert S. Burton, III

It is certified that error appears in the above-identified patent and that said Letters Patent are hereby corrected as shown below:

Column 6, line 50, -- oil -- should be inserted after "in situ".

Column 8, line 7, -- about -- should be inserted after "for" and before "one".

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*